US012116735B2

(12) United States Patent
Han

(10) Patent No.: US 12,116,735 B2
(45) Date of Patent: Oct. 15, 2024

(54) GRASS SKI CARPET, SPIRAL GRASS ASSEMBLY, AND SPIRAL GRASS

(71) Applicant: Duo Han, Beijing (CN)

(72) Inventor: Duo Han, Beijing (CN)

( * ) Notice: Subject to any disclaimer, the term of this patent is extended or adjusted under 35 U.S.C. 154(b) by 243 days.

(21) Appl. No.: 17/665,434

(22) Filed: Feb. 4, 2022

(65) Prior Publication Data

US 2023/0250594 A1 Aug. 10, 2023

(51) Int. Cl.

| | |
|---|---|
| ***E01C 13/08*** | (2006.01) |
| ***A63C 19/04*** | (2006.01) |
| ***A63C 19/10*** | (2006.01) |
| ***E01C 13/10*** | (2006.01) |

(52) U.S. Cl.

CPC ..... *E01C 13/08* (2013.01); *A63C 19/04* (2013.01); *A63C 19/10* (2013.01); *E01C 13/10* (2013.01)

(58) Field of Classification Search

CPC ..... E01C 13/00; E01C 13/08; E01C 13/10; A63C 19/04; A63C 19/10

USPC ..... 472/89, 90–92

See application file for complete search history.

(56) References Cited

U.S. PATENT DOCUMENTS 5,462,778 A * 10/1995 Ishikawa ..... E01C 13/08 428/397
5,647,804 A * 7/1997 Homma ..... E01C 5/20 472/90
10,174,463 B1 * 1/2019 Yuan ..... E01C 13/12
2019/0040591 A1 * 2/2019 De Maria ..... E01C 5/001
2020/0347558 A1 * 11/2020 Aumonier ..... B29D 99/0078
2021/0180270 A1 * 6/2021 Meherg ..... E01C 13/083

FOREIGN PATENT DOCUMENTS

| | | | |
|---|---|---|---|
| CN | 205391693 | U | 7/2016 |
| CN | 106390431 | A | 2/2017 |
| CN | 206109925 | U | 4/2017 |
| CN | 108486992 | A | 9/2018 |
| JP | 2008184734 | A | 8/2008 |
| WO | 2017211086 | A1 | 12/2017 |

* cited by examiner

*Primary Examiner* — Kien T Nguyen
(74) *Attorney, Agent, or Firm* — Chun-Ming Shih; LANWAY IPR SERVICES

(57) ABSTRACT

A grass ski carpet, comprising a plurality of spiral grass assemblies arranged regularly, wherein each spiral grass assembly comprises: a plurality of row brushes arranged in a same direction, wherein each row brush comprises a base bar and multiple pieces of spiral grass, the multiple pieces of spiral grass are spaced apart and fixedly connected to a first surface of the base bar, the multiple pieces of spiral grass are arranged in a same direction, each of the multiple pieces of spiral grass has a grass tip, a grass stem, and a grass root, the grass stem is curved, the grass tip is bulbous, and rotation directions of all the multiple pieces of spiral grass are same; and a base plate fixedly connected to each of the multiple row brushes through a detachable structure, so that the multiple row brushes are arranged on a surface of the base plate.

20 Claims, 6 Drawing Sheets

1

GRASS SKI CARPET, SPIRAL GRASS ASSEMBLY, AND SPIRAL GRASS

TECHNICAL FIELD

The present disclosure relates to a grass ski carpet, a spiral grass assembly, and spiral grass.

BACKGROUND

Skiing is a competitive/non-competitive sport of sliding, jumping and downhill on skis over snow.

At early times, people skied only in a few areas where it is very cold in winter. However, people hope to ski anywhere and anytime. In view of this, dry skiing is invented. Dry skiing is not affected by times, seasons, and geographic locations. Therefore, dry skiing is time and spatial extension of skiing. The birth of dry skiing breaks the limit that people only ski in an area where it is very cold in winter. Dry skiing slope may be built in scenic spots with great passenger flows in southern areas and outskirts, to become sports places for people after their meals or teas or on weekends.

SUMMARY

One aspect of the present disclosure provides a grass ski carpet, including: a plurality of spiral grass assemblies arranged regularly, wherein each of the plurality of spiral grass assemblies comprises:

a plurality of row brushes arranged in a same direction, wherein each of the plurality of row brushes comprises a base bar and a plurality of pieces of spiral grass, the plurality of pieces of spiral grass are spaced apart and fixedly connected to a first surface of the base bar, the plurality of pieces of spiral grass are arranged in a same direction, each of the plurality of pieces of spiral grass has a grass tip, a grass stem, and a grass root, a stem of each of the plurality of pieces of spiral grass has a curved shape, a tip of each of the plurality of pieces of spiral grass is bulbous, and rotation directions of all the plurality of pieces of spiral grass are same; and a base plate fixedly connected to each of the plurality of row brushes via a detachable structure, so that the plurality of row brushes are arranged on a first surface of the base plate.

In an embodiment of the present disclosure, spiral grass of each of the plurality of row brushes are divided into at least two layers according to heights thereof, and the at least two layers of spiral grass are arranged in a staggered manner, wherein spiral grass of a top layer is configured to support skis and for carving of skis, and spiral grass of remaining layers is configured for support and shock absorption to prevent the spiral grass from collapsing.

In an embodiment of the present disclosure, a stem of each of the plurality of pieces of spiral grass is cylindrical, and a diameter of a root of each of the plurality of pieces of spiral grass is greater than a diameter of a stem thereof.

In an embodiment of the present disclosure, the detachable structure includes:

a plurality of hooks provided on a second surface of the corresponding base bar, where the plurality of hooks are arranged at intervals in the length direction of the corresponding base bar, and the plurality of hooks are arranged in the same direction, wherein the second surface of the base bar is opposite to the first surface of the base bar; and a plurality of insertion holes corresponding to the plurality of hooks in one-to-one manner, wherein the plurality of insertion holes are arranged in rows in the base plate, and each of the plurality of insertion holes passing through the base plate, wherein the plurality of hooks pass through the plurality of insertion holes correspondingly to fix the plurality of row brush on the base plate.

In an embodiment of the present disclosure, the base plate further includes:

a pair of holding clips, each holding clip of the pair of holding clips protruding outward with respect to the surface of the base plate on which the row brushes are mounted, and holding clips of the pair of holding clips are arranged on a side of each insertion hole respectively, and the pair of holding clips is configured to stabilize a corresponding row brush to ensure that the spiral grass of the row brush is fixed without loosing; and a water drain hole disposed at a remaining position of the base plate, wherein the water drain hole passing through the base plate.

In an embodiment of the present disclosure, the base plate further includes a plurality of supports disposed on a second surface of the base plate and configured to support the base plate such that there is a space at a bottom of the base plate.

In an embodiment of the present disclosure, each spiral grass assembly further includes a grid plate with a shape consistent with a shape of the base plate, and the grid plate is arranged below the base plate, and is fixedly connected, by means of a connecting piece, to the base plate and a row brush disposed adjacent to an edge of the base plate.

In an embodiment of the present disclosure, the grass ski carpet further includes a foundation configured to be a mounting foundation on which the plurality of spiral grass assemblies are mounted.

Another aspect of the present disclosure provides a spiral grass assembly, including:

a plurality of row brushes arranged in a first direction, wherein each of the plurality of row brush comprises a base bar and a plurality of pieces of spiral grass, the plurality of pieces of spiral grass are spaced apart and fixedly connected to a first surface of the base bar, the plurality of pieces of spiral grass are arranged in a second direction, each of the plurality of pieces of spiral grass has a grass tip, a grass stem, and a grass root, a stem of each of the plurality of pieces of spiral grass is curved, a tip of each of the plurality of piece of spiral grass is bulbous, and rotation directions of all the of the plurality of pieces of spiral grass are same; and a base plate fixedly connected to each of the plurality of row brushes through a detachable structure, so that the plurality of row brushes are arranged on a first surface of the base plate.

In an embodiment of the present disclosure, the spiral grass in each of the plurality of row brushes is divided into at least two layers according to heights thereof, and the at least two layers of spiral grass are arranged in a staggered manner, where the spiral grass on a top layer is configured to support a skis and for carving of the skis, and the spiral grass of other layers among the at least two layers is configured for support and shock absorption to prevent the spiral grass from collapsing.

In an embodiment of the present disclosure, a stem of each piece of spiral grass is cylindrical, and the diameter of a root of each piece of spiral grass is greater than the diameter of a stem of each piece of spiral grass.

In an embodiment of the present disclosure, each detachable structure includes:

a plurality of hooks formed on another surface of a corresponding base bar, wherein the plurality of hooks are arranged at intervals in a length direction of the corresponding base bar, and the plurality of hooks are arranged in a same direction; and a plurality of insertion holes, corresponding to the plurality of hooks in one-to-one manner, wherein the plurality of insertion holes is disposed in rows at the base plate, and each of the plurality of insertion holes passes through the base plate, wherein the plurality of hooks passes through the plurality of insertion holes respectively to fix respective row brushes on the base plate.

In an embodiment of the present disclosure, the base plate further includes:

a pair of holding clips, each holding clips of the pair of holding clips protruding outward with respect to a surface of the base plate on which the row brushes are mounted, wherein holding clips of the pair of holding clips are respectively arranged on a side of each of the plurality of insertion holes, and the pair of holding clips is used to stabilize the corresponding row brush to ensure that spiral grass of the corresponding row brushes is fixed without loosing; and a water drain hole disposed at a remaining position of the base plate, wherein the water drain hole pass through the base plate for ventilation, water drain, and sewage discharge.

In an embodiment of the present disclosure, the base plate further includes a plurality of supports disposed at said another surface of the base plate configured to support the base plate such that there is a space below a bottom of the base plate.

In an embodiment of the present disclosure, each spiral grass assembly further includes a grid plate with a shape consistent with a shape of the base plate, and the grid plate is arranged below the base plate, and is fixedly connected, through of a connecting piece, to the base plate and a row brush disposed adjacent to an edge of the base plate.

Another aspect of the present disclosure further provides a piece of spiral grass, wherein the piece of the spiral grass has a grass tip, a grass stem, and a grass root, the grass stem is curved, and the grass tip is bulbous.

In an embodiment of the present disclosure, the grass stem is cylindrical, and a diameter of the grass root is greater than a diameter of the grass stem.

The present disclosure provides a grass ski carpet, a spiral grass assembly, and spiral grass, where the grass ski carpet includes a plurality of spiral grass assemblies. Each of the plurality of pieces of spiral grass assembly includes a base plate and a plurality of row brushes arranged on the base plate. Each of plurality of row brushes includes base bar and a plurality of pieces of spiral grass fixedly connected to the base bar. Each of the plurality of pieces of spiral grass has a curved grass stem and a bulbous grass tip, and rotation directions of all the plurality of pieces of spiral grass are same, and all the plurality of pieces of spiral grass are arranged in a same direction. Due to the foregoing structure, the spiral grass according to the present disclosure has characteristics of good elasticity, flexibility, and being hard to fall off. Since there is a gap between adjacent pieces of spiral grass, impurities and dust can automatically slide off, thus facilitating self-cleaning. Therefore, the grass ski carpet has advantages of soft support and elastic shock absorption, which facilitates sliding and carving of skis.

Based on the following detailed description of specific embodiments of the present disclosure in accordance with the accompanying drawings, a person skilled in the art will better understand the foregoing and other objectives, advantages, and features of the present disclosure.

DETAILED DESCRIPTION OF THE EMBODIMENTS

Figure 1:
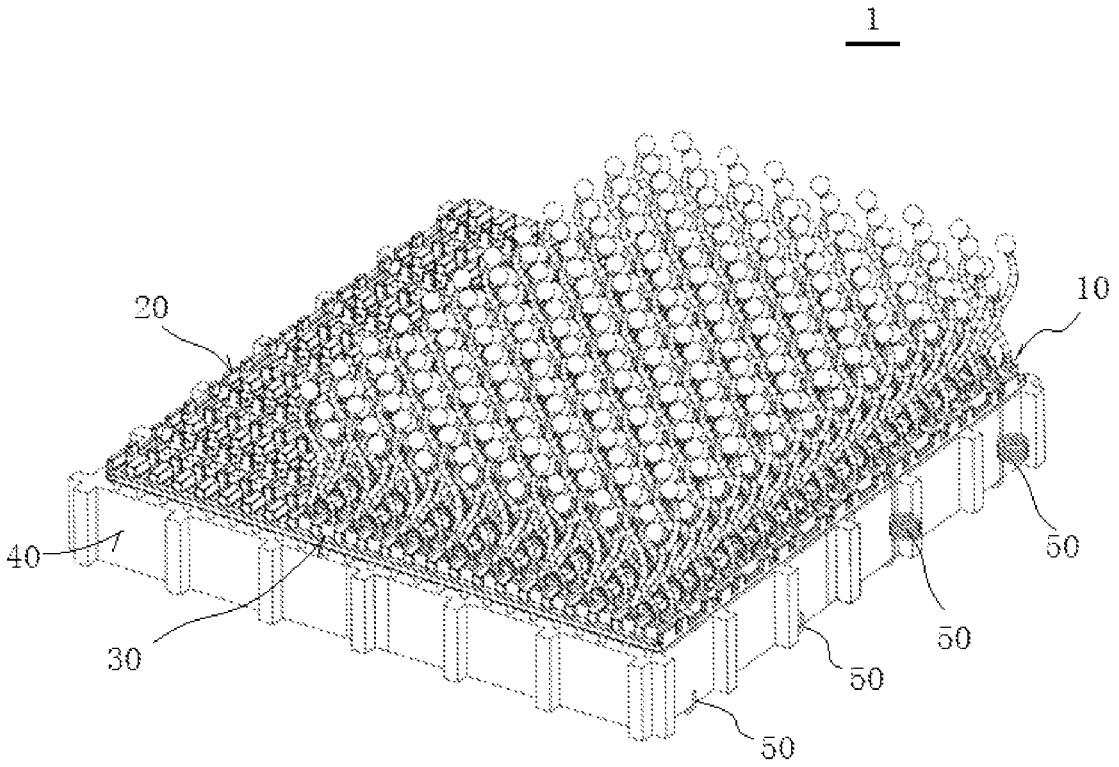
FIG. 1 is a schematic three dimensional view of a spiral grass assembly in a grass skiing carpet according to an embodiment of the present disclosure.
Figure 2:
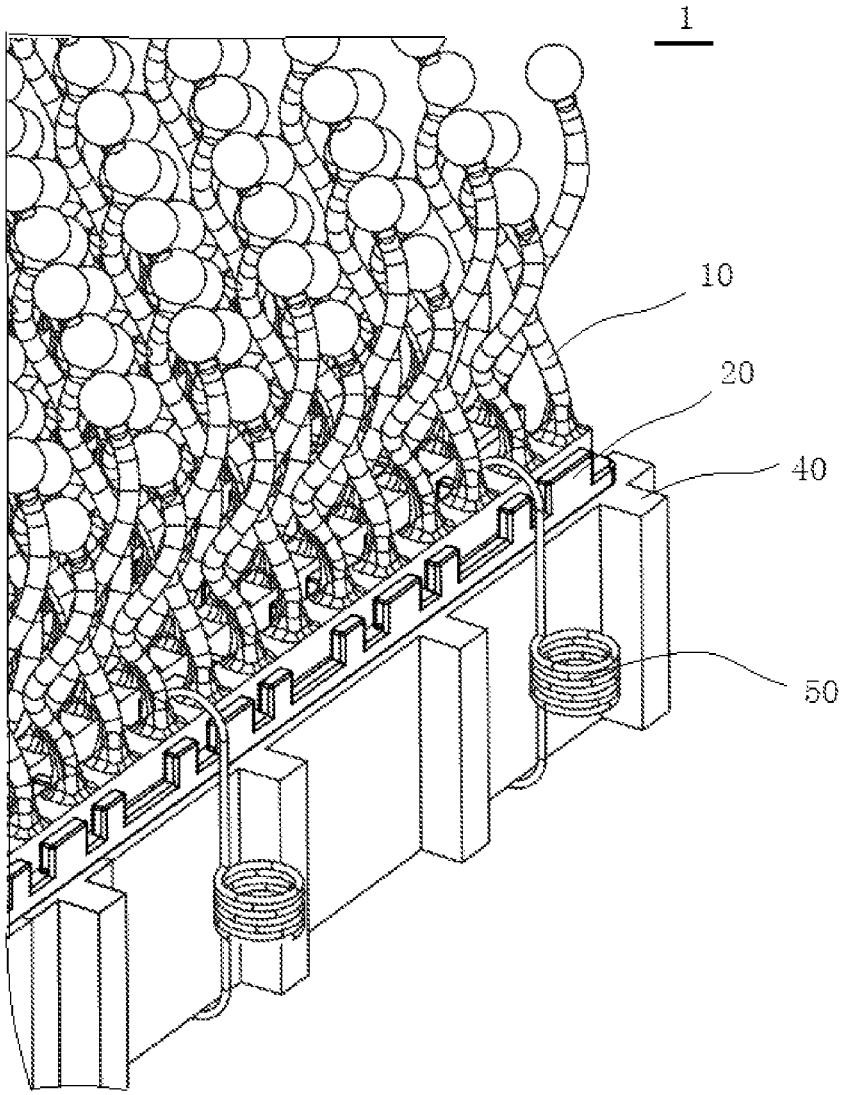
FIG. 2 is a schematic partial three dimensional view of a spiral grass assembly in FIG. 1.
Figure 3:
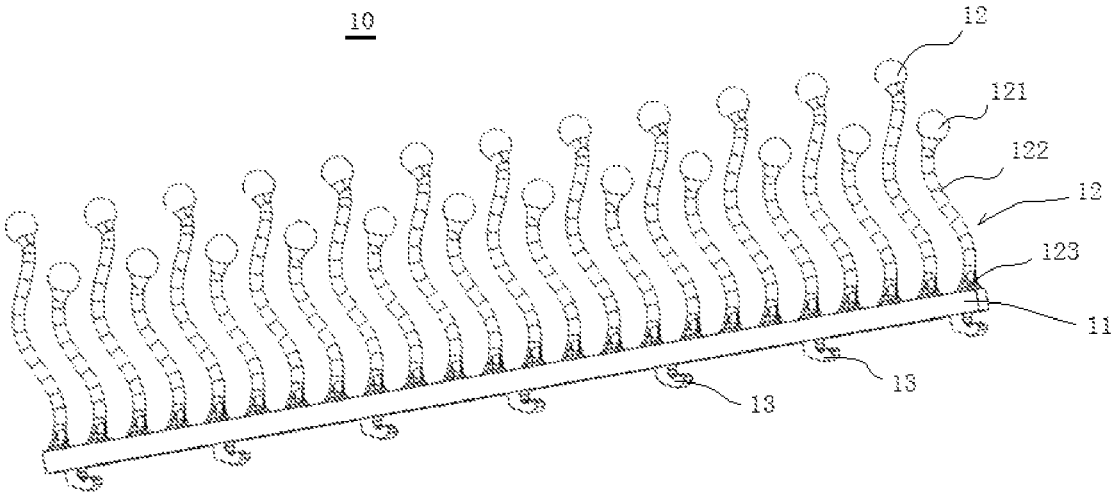
FIG. 3 is a schematic three dimensional view of a row brush in a grass ski carpet according to an embodiment of the present disclosure.
Figure 4:
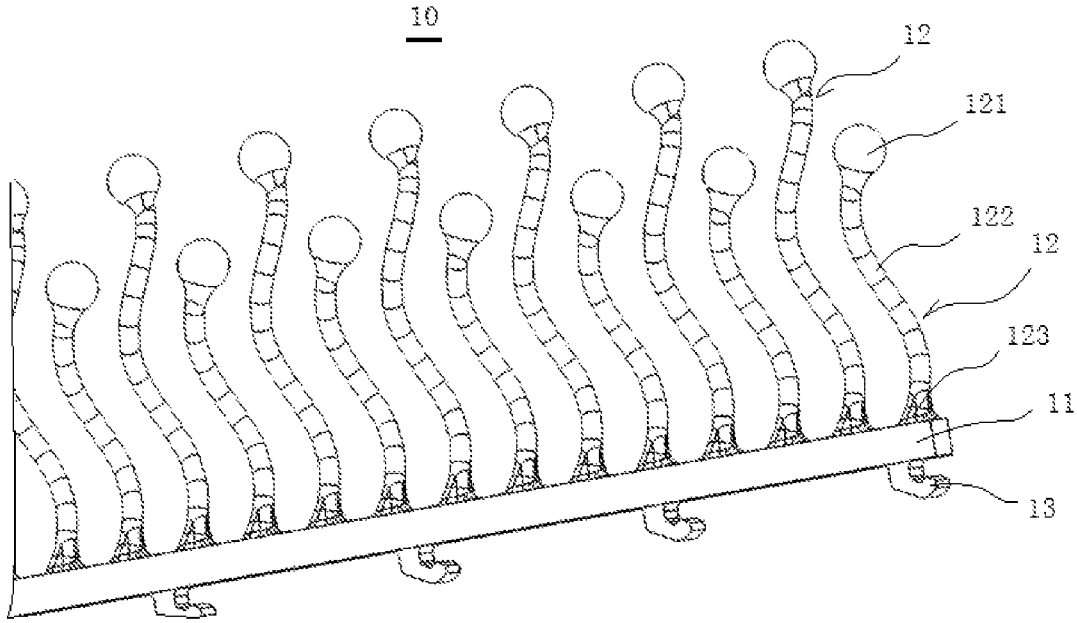
FIG. 4 is a schematic partial three dimensional view of a row brush in FIG. 3.
Figure 5:
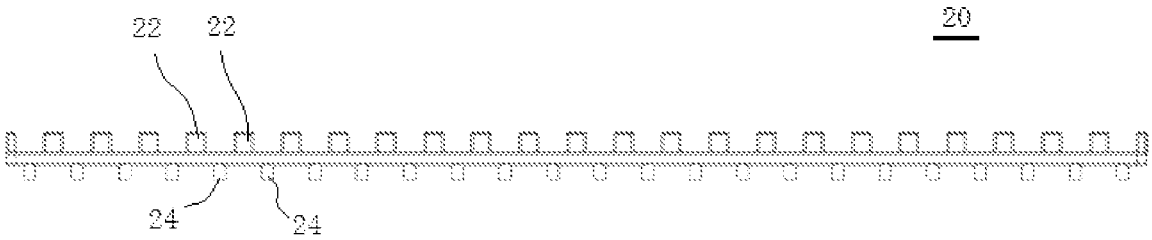
FIG. 5 is a schematic front view of a base plate in a grass ski carpet according to an embodiment of the present disclosure.
Figure 6:
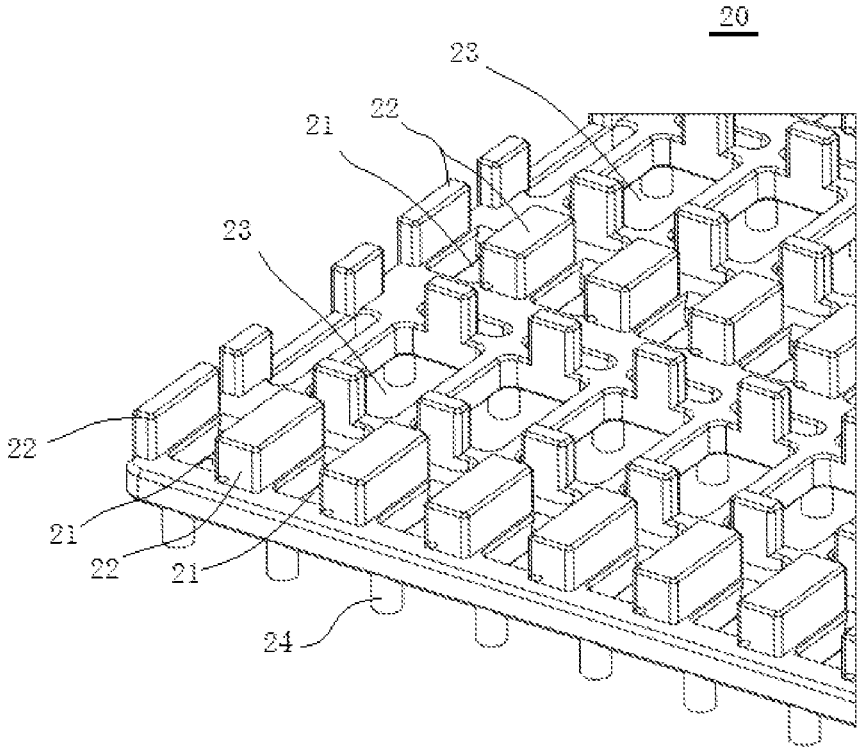
FIG. 6 is a schematic partial enlarged three dimensional view of a base plate in FIG. 1.
Figure 7:
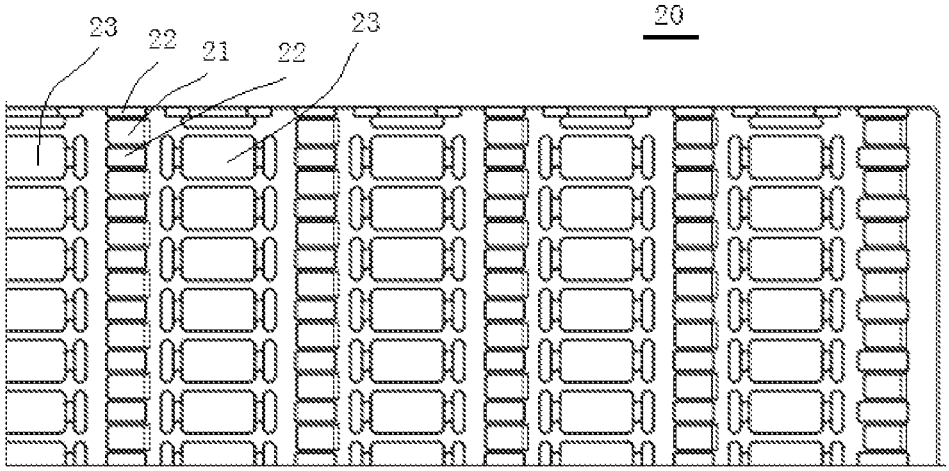
FIG. 7 is a schematic partial top view of a base plate in FIG. 5.
Figure 8:
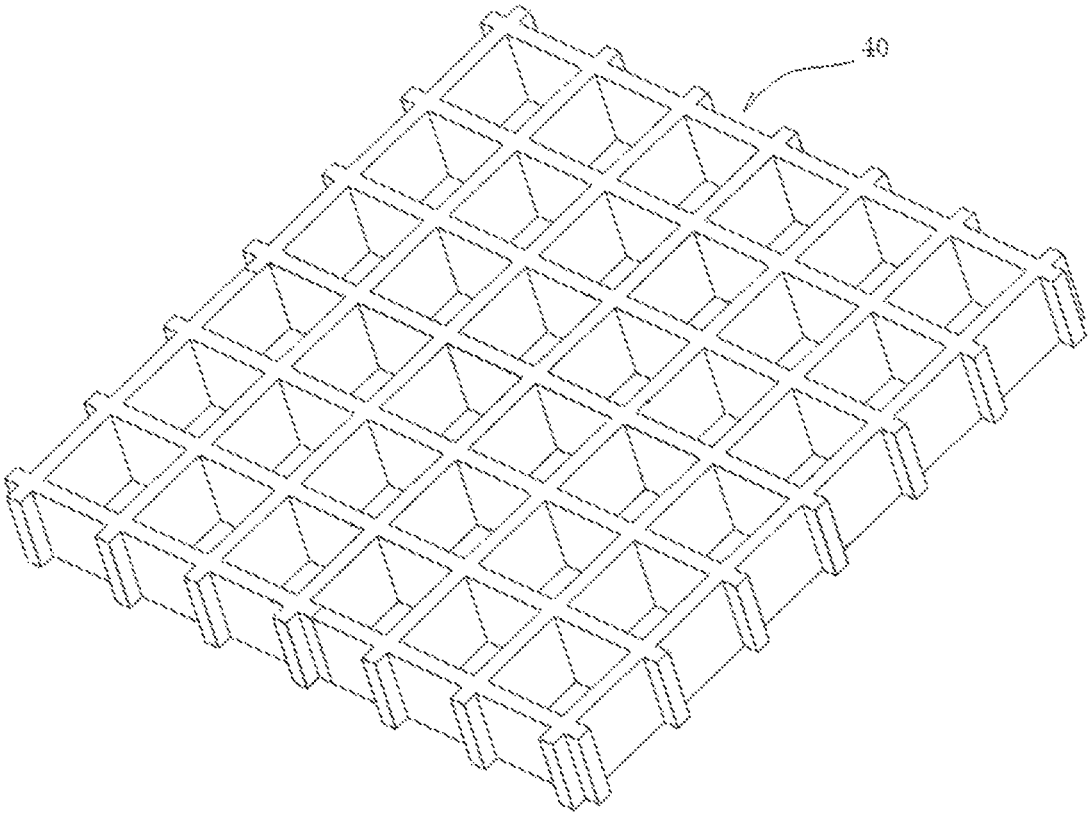
FIG. 8 is a schematic three dimensional view of a grid plate in a grass skiing carpet according to an embodiment of the present disclosure.
Figure 9:
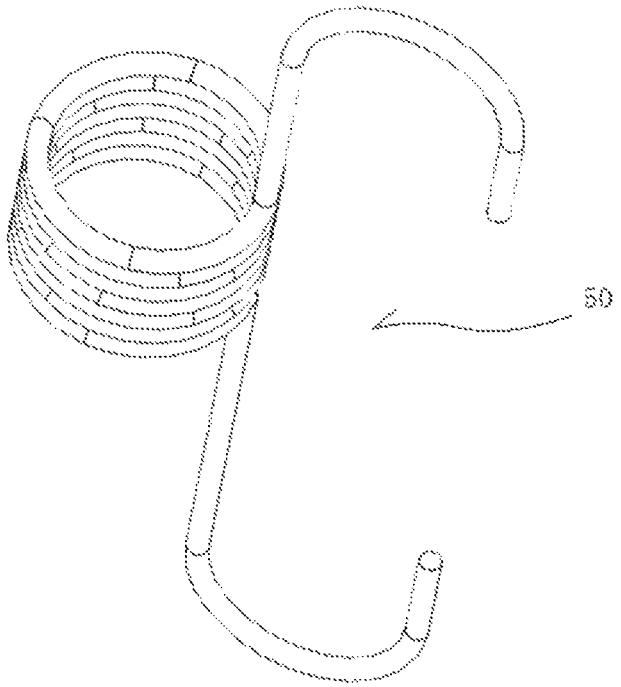
FIG. 9 is a schematic three dimensional view of a connecting piece in FIG. 1.

FIG. 1 is a schematic three dimensional view of a spiral grass assembly in a grass ski carpet according to an embodiment of the present disclosure. FIG. 2 is a schematic partial three dimensional view of a spiral grass assembly in FIG. 1. FIG. 3 is a schematic three dimensional view of a row brush of a grass ski carpet according to an embodiment of the present disclosure. FIG. 4 is a schematic partial three dimensional view of a row brush in FIG. 3. FIG. 5 is a schematic front view of a base plate of a grass ski carpet according to an embodiment of the present disclosure. FIG. 6 is a schematic partial enlarged three dimensional view of a base plate in FIG. 1. FIG. 7 is a schematic partial top view of a base plate in FIG. 5. FIG. 8 is a schematic three dimensional view of a grid plate of a grass ski carpet according to an embodiment of the present disclosure. FIG. 9 is a schematic three dimensional view of a connecting piece in FIG. 1.

As illustrated in FIG. 1, in conjunction with FIG. 2 to FIG. 8, in this embodiment, a grass ski carpet is provided for paving a "dry skiing slope". The grass ski carpet may usually include a plurality of spiral grass assemblies 1 arranged regularly. Each spiral grass assembly 1 may include a plurality of row brushes 10 and a base plate 20. The plurality of row brushes 10 are arranged in a same direction. Each of the plurality of row brushes 10 includes a base bar 11 and a plurality of pieces of spiral grass 12. The base bar 11 is configured to support the plurality of pieces of spiral grass 12. The base bar 11 may has a shape of long strip. The plurality of pieces of spiral grass 12 are spaced apart and fixedly connected to a surface of the base bar 11. The plurality of pieces of spiral grass 12 are arranged in a same direction. Each of the plurality of pieces of spiral grass 12 has a grass tip 121, a grass stem 122, and a grass root 123.

The grass stem 122 of each of the plurality of pieces of spiral grass 12 has a curved shape. The grass tip 121 of each of the plurality of pieces of spiral grass 12 is bulbous, which will not hurt a fallen skater, nor damage ski gear or ski clothing. Rotation directions of all the plurality of pieces of spiral grass 12 are the same. The base plate 20 may be fixedly connected to each of the plurality of row brushes 10 through a detachable structure 30, so that the plurality of row brushes 10 are arranged on a surface of the base plate 20. More specifically, there is a gap between adjacent pieces of spiral grass 12. There is a distance between adjacent row brushes 10.

In an embodiment of the present disclosure, the spiral grass 12 may be made first, and then the spiral grass 12 is assembled on the base bar 11 to form the row brushes 10. The assembling is achieved through interference connection or bonding after insertion. The base plate 20 may be rectangular, and a length of the base plate 20 is the same as a length of the row brushes 10. The width of the base plate 20 depends on the quantity of the row brushes 10, and 5 to 30 row brushes 10 may be mounted on a base plate 20. The base plate 20 on which the row brushes 10 have been assembled forms the spiral grass assembly 1.

Furthermore, in this embodiment, the base plate 20 is designed to be capable of being bent to adapt to paving of undulating surfaces, and particularly, to paving of rolling skiing slopes.

The grass ski carpet according to the present disclosure includes a plurality of spiral grass assemblies 1. Each of the plurality of spiral grass assembly 1 includes a base plate 20 and a plurality of row brushes 10 arranged on the base plate 20. Each of the plurality of row brush 10 includes a base bar 11 and a plurality of pieces of spiral grass 12 fixedly connected to the base bar. Each of the plurality of pieces of spiral grass 12 has a curved stem 122 and a bulbous tip 121, and rotation directions of all the pieces of spiral grass 12 are the same, and the plurality of pieces of spiral grass 12 are arranged in a same direction. Due to the foregoing structure, the spiral grass 12 according to the present disclosure has characteristics of good elasticity, flexibility, and being hard to fall off. Since there is a gap between adjacent pieces of spiral grass 12, and there is a distance between adjacent row brushes 10, impurities and dust can automatically slide off, thus facilitating self-cleaning. Therefore, the grass ski carpet has advantages of soft support and elastic shock absorption, which facilitates sliding and carving of skis.

The grass ski carpet according to the present disclosure may be directly paved into a dry skiing slope, allowing skiers to ski with winter skiing gear and skiing skill, without restriction by the temperature, and with no water and electricity consumption.

The dry skiing slope paved with the grass ski carpet according to the present disclosure can be used continuously for more than five years (1800 days), including daytime and evening time, and is not subject to temperature constraints, which is equivalent to a total of 20 years of business days for a real ski field.

With the grass ski carpet according to the present disclosure, no water and electricity are consumed to make snow, which is energy-saving and environmentally friendly.

A maintenance cost of the dry skiing slope paved with the grass ski carpet according to the present disclosure is less than RMB 30/square meter per year.

Through tests, a wet skiing speed on the dry skiing slope paved with the grass ski carpet according to the present disclosure can reach 90% of the speed on real snow, which can meet demands of skiing training and competition, and a dry skiing speed is 70% of the speed on real snow, which is suitable for beginners to practice skiing.

For example, as illustrated in FIG. 3, and further referring to FIG. 4, in this embodiment, spiral grass 12 of each row brush 10 is divided into at least two layers according to a height, and the at least two layers of spiral grass 12 are arranged in a staggered manner Spiral grass 12 on a top layer is configured to support the skis and for carving of the skis, and spiral grass 12 of other layers is configured to support and absorb shock to prevent the spiral grass 12 from collapsing. In this embodiment, the spiral grass 12 is divided into two layers, a high layer and a low layer. Spiral grass 12 of a higher layer is configured for edging and carving, controlling direction, and decelerating to stop. Both spiral grass 12 of the high layer and spiral grass 12 of the low layer support to ensure a support strength of the grass ski carpet.

For example, as illustrated in FIG. 3, and further referring to FIG. 4, in this embodiment, a stem 122 of each of the plurality of pieces of spiral grass 12 is cylindrical, maintaining same elasticity in all directions, and thereby ensuring consistent supporting forces in all directions. A diameter of a root 123 of each of the plurality of pieces of spiral grass 12 is greater than a diameter of the stem 122 of each of the plurality of pieces of spiral grass, which increases strength.

For example, as illustrated in FIG. 3, and further referring to FIG. 4, in this embodiment, each of the plurality of pieces of spiral grass 12 has a spiral shape to provide resistance to impact collapse of 40 mm, cushioning, and shock absorption, and automatic recovery after impact. In other embodiments, alternatively, each of the plurality of pieces of spiral grass 12 may be in an "S" shape.

Furthermore, as illustrated in FIG. 3, and further referring to FIG. 4, in this embodiment, there is a space between two adjacent pieces of spiral grass 12 to reserve space for various functional tubes, so as to make it easy to embed heating tubes, cooling tubes, ventilation tubes, vibration tubes, water spray tubes, and LED light strips. The embedded LED light strips may be configured for auxiliary teaching, or the embedded LED light strips may be paved as racing track indication lines, or dynamic patterns controlled by a computer, which may be used for giant light advertisements and carnival neon patterns to earn luster advertising revenues. In addition, a color of the spiral grass 12 of the row brushes 10 may be changed, and colorful patterns may be assembled for advertising, so as to earn graphics advertising revenues.

For example, material for the spiral grass 12 may be metal, plastic, or a composite material. The material of the spiral grass 12 is preferably "polyoxymethylene (POM)" and the spiral grass 12 is formed through injection molding, so that the spiral grass 12 of POM has characteristics of being durable, resistive to exposure to the sun, resistive to exposure to rain or snow, friendly to environment, safe, and recyclable.

As illustrated in FIG. 1, in this embodiment, each of the plurality of detachable structures 30 may include: a plurality of hooks 13 and a plurality of insertion holes 21. As illustrated in FIG. 3, the plurality of hooks 13 are formed on another surface of a corresponding base bar 11, namely, a surface of the base bar 11 on which the spiral grass is not mounted. The plurality of hooks 13 are arranged at intervals in the length direction of the corresponding base bar 11, and the plurality of hooks 13 are arranged in the same direction. As illustrated in FIG. 6 or FIG. 7, a quantity of the plurality of insertion holes 21 corresponds to a quantity of the plurality of hooks 13, wherein the plurality of insertion holes 21 is formed in rows in the base plate 20, and each of the plurality of insertion hole 21 passes through the base plate 20. The plurality of hooks 13 passes through the plurality of corresponding insertion holes 21 to fix a corresponding row brush 10 on the base plate 20. In other embodiments, each detachable structure 30 may alternatively be a plug-in structure, a buckle structure, or other detachable structures.

For example, as illustrated in FIG. 6, in this embodiment, each insertion hole 21 is a wedge-shaped insertion hole, and the hook 13 engages with the wedge-shaped insertion hole to ensure that the corresponding row brush 10 will not fall off.

Furthermore, as illustrated in FIG. 6, in this embodiment, the base plate 20 further includes: a plurality of holding clips 22 and a plurality of water drain holes 23. Each of the plurality of holding clips 22 protrudes outward relative to a surface of the base plate 20 on which the row brushes 10 are mounted. Two holding clips 22 form a pair of holding clips, and each pair of holding clips 22 is correspondingly arranged on both sides of an insertion hole 21, and each pair of holding clips 22 is configured to stabilize a corresponding row brush 10 to ensure that spiral grass 12 on the row brushes 10 is stable and not loose. The plurality of water drain holes 23 are distributed at remaining positions of the base plate 20, where each of the plurality of water drain hole 23 penetrates the base plate 20 for ventilation, water drain, and sewage discharge.

Furthermore, as illustrated in FIG. 7, in this embodiment, the base plate 20 further includes a plurality of supports 24 formed at the another surface of the base plate 20, namely, a surface of the base plate 20 on which no holding clip 22 is arranged. The plurality of supports 24 is configured to support the base plate 20 such that there is a space at a bottom of the base plate 20 for ventilation, water drain, and sewage discharge.

Furthermore, as illustrated in FIG. 1, and further referring to FIG. 8, in this embodiment, each of the plurality of spiral grass assembly 1 further includes a grid plate 40 with a shape consistent with a shape of the base plate 20, and the grid plate 40 is disposed below the base plate 20. As illustrated in FIG. 1, the grid plate 40 is fixedly connected, through a connecting piece 50, to the base plate 20 and row brushes 10 at edges of the base plate 20. The grid plate 40 has advantages of no dirt accumulation and self-cleaning.

For example, as illustrated in FIG. 9, the connecting piece 50 in this embodiment comprises a spiral hook. Preferably, the spiral hook is a stainless-steel spiral hook. More specifically, a middle part of the spiral hook is a spring, two ends of the spiral hook are corresponding hooks, and the hooks at both ends are arranged in the same direction, thereby facilitating repeated disassembling and assembling. In other embodiments, the connecting piece 50 may alternatively be a strap or other components with connecting function.

In an embodiment of the present disclosure, the spiral grass assembly 1 may be designed as a square slider unit of 240 mm×240 mm×60 mm to be independently assembled through a spiral hook, which is convenient for operation, maintenance, and pattern assembly.

For example, in this embodiment, the grass ski carpet further includes a foundation configured as an assembling foundation on which the plurality of spiral grass assemblies 1 are mounted. For example, when paving a moguls field, self-tapping screws may be adopted for direct mounting.

In an embodiment of the present disclosure, as illustrated in FIG. 1, the base plate 20 on which the row brushes 10 have been mounted is laid on the grid plate, then the base plate is fixed with a spiral hook, and then the grid plate is mounted on the foundation. The foundation may be a steel frame keel.

Referring to FIG. 1, and further referring to FIG. 2 to FIG. 8, this embodiment further provides a spiral grass assembly 1 that may typically include a plurality of row brushes 10 and a base plate 20. The plurality of row brushes 10 are arranged in a same direction. Each of the plurality of row brushes 10 includes a base bar 11 and a plurality of pieces of spiral grass 12. The base bar 11 is configured to support the plurality of pieces of spiral grass 12. The base bar 11 may have a shape of long strip. The plurality of pieces of spiral grass 12 is spaced apart and fixedly connected to a surface of the base bar 11. The plurality of pieces of spiral grass 12 are arranged in a same direction. Each of the plurality of pieces of spiral grass 12 has a grass tip 121, a grass stem 122, and a grass root 123. The grass stem 122 of each of the plurality of pieces of spiral grass 12 has a curved shape. The grass tip 121 of each of the plurality of pieces of spiral grass 12 is bulbous, which will not hurt a fallen skier, nor damage ski gear and wear. Rotation directions of all the plurality of pieces of spiral grass 12 are same. The base plate 20 may be fixedly connected to the plurality of row brushes 10 by means of a detachable structure 30, so that the plurality of row brushes 10 are arranged on a surface of the base plate 20. More specifically, there is a gap between adjacent pieces of spiral grass 12, and there is a distance between adjacent row brushes 10.

The spiral grass assembly according to this embodiment has a same structure as the spiral grass assembly 1 according to the foregoing embodiment, and details of the structure of the spiral grass assembly will not be elaborated here.

The spiral grass assembly 1 according to the present disclosure includes a base plate 20 and a plurality of row brushes 10 arranged on the base plate 20. Each of the plurality of row brushes 10 includes a base bar 11 and a plurality of pieces of spiral grass 12 fixedly connected to the base bar. Each of the plurality of pieces of spiral grass 12 has a spiral stem 122 and a bulbous tip 121, and rotation directions of all the plurality of pieces of spiral grass 12 are identical, and the plurality of pieces of spiral grass 12 are arranged in a same direction. Due to the foregoing structure, the spiral grass 12 according to the present disclosure has characteristics of excellent elasticity, flexibility, and being hard to fall off. Since there is a gap between adjacent pieces of spiral grass 12, impurities and dust can automatically slide off, thus facilitating self-cleaning. Therefore, the spiral grass assembly 1 has advantages of soft support and elastic shock absorption.

Referring to FIG. 1, and further referring to FIG. 2 to FIG. 4, this embodiment further provides spiral grass 12 having a grass tip 121, a grass stem 122, and a grass root 123. The grass stem 122 has a curved shape, and the grass tip 121 is bulbous.

The spiral grass according to this embodiment has a same structure as the spiral grass 12 described in the foregoing embodiment, and details of the structure of the spiral grass will not be elaborated here.

The spiral grass 12 according to the present disclosure has a curved stem 122 and a bulbous tip 121, and rotation directions of all the plurality of pieces of spiral grass 12 are same, and the plurality of pieces of spiral grass 12 are arranged in a same direction. Due to the foregoing structure, the spiral grass 12 according to the present disclosure has characteristics of good elasticity, flexibility, and being hard to fall off.

It should be noted that the grass ski carpet, the spiral grass assembly 1, and the spiral grass 12 according to the present disclosure may further be applied to the field of daily necessities, for example, mattresses, gymnastics massage mats, and shower massage mats.

When used as a mattress, compared with mattresses in the prior art, the grass ski carpet can meet demands of common people, and has functions of soft supporting, keeping warm, and comfort. While making the mattress elastic, the mattress according to the present disclosure achieves various functions such as ventilation, vibration, temperature adjustment, or spraying water mist by adding air supply pipe ventilation, vibration tube massage, cold and heat pipe temperature adjustment, and spraying water mist through water spraying pipe, for frail elder, severely injured patients, or some special groups of people to use.

When as a gymnastic massage mat, compared with the prior art in which there is no solution of allowing pedestrians or athletes on the mat to have a massage while exercising, the gymnastics massage mat according to the present disclosure can give pedestrians or athletes on the mat a massage incidentally while exercising.

When as a shower massage mat, compared with a shower mat in the prior art with which no foot massage cannot be completed while showering, the shower massage mat according to the present disclosure can give a foot massage to bathers incidentally while taking a shower.

In conclusion, one of ordinary skill in the art should realize that although some exemplary of embodiments of the present disclosure have been illustrated and described in detail in this specification, many other variations or modifications that conform to principles of the present disclosure may still be directly determined or deduced based on content disclosed in this application without departing from the gist and the scope of the present disclosure. Therefore, the scope of the present disclosure should be understood and deemed to cover all these other variations or modifications.

The invention claimed is:

1. A grass ski carpet, comprising a plurality of spiral grass assemblies arranged regularly, wherein each of the plurality of spiral grass assembly comprises:

a plurality of row brushes arranged in a same direction, wherein each of the plurality of row brushes comprises a base bar and a plurality of pieces of spiral grass, the plurality of pieces of spiral grass are spaced apart and fixedly connected to a first surface of the base bar, the plurality of pieces of spiral grass are arranged in a same direction, each of the plurality of pieces of spiral grass has a grass tip, a grass stem, and a grass root, the grass stem of each of the plurality of pieces of spiral grass is curved, the grass tip of each of the plurality of pieces of spiral grass is bulbous, and rotation directions of all the plurality of pieces of spiral grass are same; and a base plate fixedly connected to each of the plurality of row brushes through a detachable structure, so that the plurality of row brushes are arranged on a surface of the base plate.

2. The grass ski carpet according to claim 1, wherein the spiral grass of each of the plurality of row brushes is divided into at least two layers according to heights thereof, and the at least two layers of spiral grass are arranged in a staggered manner, wherein spiral grass of a top layer is configured to support a skis and for carving of the skis, and spiral grass of other layers of the at least two layers is configured for support and shock absorption to prevent the spiral grass from collapsing.

3. The grass ski carpet according to claim 2, further comprising a foundation configured as a mounting foundation on which the plurality of spiral grass assemblies are mounted.

4. The grass ski carpet according to claim 1, wherein the grass stem is cylindrical, and a diameter of the grass root is greater than a diameter of the grass stem.

5. The grass ski carpet according to claim 4, further comprising a foundation configured as a mounting foundation on which the plurality of spiral grass assemblies are mounted.

6. The grass ski carpet according to claim 1, wherein the detachable structure comprises:

a plurality of hooks provided on a second surface of the corresponding base bar, wherein the plurality of hooks are arranged at intervals in a length direction of the corresponding base bar, and the plurality of hooks are arranged in a same direction; and a plurality of insertion holes, corresponding to the plurality of hooks in one-to-one manner, wherein the plurality of insertion holes are provided in rows in the base plate, and each of the plurality of insertion holes passing through the base plate;

wherein the plurality of hooks pass through the plurality of corresponding insertion holes to fix the corresponding row brush on the base plate.

7. The grass ski carpet according to claim 6, further comprising a foundation configured as a mounting foundation on which the plurality of spiral grass assemblies are mounted.

8. The grass ski carpet according to claim 1, wherein the base plate further comprises:

a pair of holding clips, each protruding outward relative to the surface of the base plate on which the row brushes are mounted, wherein two holding clips are a pair, and each holding clip of the pair of holding clips are arranged on a side of each insertion hole respectively, and the pair of holding clips is configured to stabilize the corresponding row brush to ensure that spiral grass on the row brushes is stable without loosing; and a water drain hole disposed at a remaining position of the base plate, wherein the water drain hole passing through the base plate for ventilation, water drain, and sewage discharge.

9. The grass ski carpet according to claim 1, wherein the base plate further comprises a plurality of supports disposed at said another surface of the base plate and configured to support the base plate such that there is a space at the bottom of the base plate for ventilation, water drain, and sewage discharge.

10. The grass ski carpet according to claim 1, wherein each spiral grass assembly further comprises a grid plate with a shape consistent with a shape of the base plate, and the grid plate is disposed below the base plate, and is fixedly connected, through a connecting piece, to the base plate and a row brush disposed adjacent to an edge of the base plate.

11. The grass ski carpet according to claim 1, further comprising a foundation configured as a mounting foundation on which the plurality of spiral grass assemblies are mounted.

12. A spiral grass assembly, comprising:

a plurality of row brushes arranged in a same direction, wherein each of the plurality of row brushes comprises a base bar and a plurality of pieces of spiral grass, the plurality of pieces of spiral grass are spaced apart and fixedly connected to a surface of the base bar, the plurality of pieces of spiral grass are arranged in a same direction, each of the plurality of pieces of spiral grass has a grass tip, a grass stem, and a grass root, the grass stem of each of the plurality of pieces of spiral grass is curved, the grass tip of each of the plurality of pieces of spiral grass is bulbous, and rotation directions of all the plurality of pieces of spiral grass are same; and a base plate fixedly connected to each of the plurality of row brushes through a detachable structure, so that the plurality of row brushes are arranged on a surface of the base plate.

13. The spiral grass assembly according to claim 12, wherein each of the pieces spiral grass comprising a grass tip, a grass stem, and a grass root, wherein the grass stem is curved, and the grass tip is bulbous.

14. The spiral grass assembly according to claim 13, wherein the grass stem is cylindrical, and a diameter of the grass root is greater than a diameter of the grass stem.

15. The spiral grass assembly according to claim 12, wherein the spiral grass in each of the plurality of row brushes is divided into at least two layers according to heights thereof, and the at least two layers of spiral grass are arranged in a staggered manner, where the spiral grass on a top layer is configured to support a skis and for carving of the skis, and the spiral grass of other layers among the at least two layers is configured for support and shock absorption to prevent the spiral grass from collapsing.

16. The spiral grass assembly according to claim 12, wherein a stem of each piece of spiral grass is cylindrical, and the diameter of a root of each piece of spiral grass is greater than the diameter of a stem of each piece of spiral grass.

17. The spiral grass assembly according to claim 12, wherein each detachable structure includes:

a plurality of hooks formed on another surface of a corresponding base bar, wherein the plurality of hooks are arranged at intervals in a length direction of the corresponding base bar, and the plurality of hooks are arranged in a same direction; and a plurality of insertion holes, corresponding to the plurality of hooks in one-to-one manner, wherein the plurality of insertion holes is disposed in rows at the base plate, and each of the plurality of insertion holes passes through the base plate, wherein the plurality of hooks passes through the plurality of insertion holes respectively to fix respective row brushes on the base plate.

18. The spiral grass assembly according to claim 12, wherein the base plate further includes:

a pair of holding clips, each holding clips of the pair of holding clips protruding outward with respect to a surface of the base plate on which the row brushes are mounted, wherein holding clips of the pair of holding clips are respectively arranged on a side of each of the plurality of insertion holes, and the pair of holding clips is used to stabilize the corresponding row brush to ensure that spiral grass of the corresponding row brushes is fixed without loosing; and a water drain hole disposed at a remaining position of the base plate, wherein the water drain hole pass through the base plate for ventilation, water drain, and sewage discharge.

19. The spiral grass assembly according to claim 12, wherein the base plate further includes a plurality of supports disposed at said another surface of the base plate configured to support the base plate such that there is a space below a bottom of the base plate.

20. The spiral grass assembly according to claim 12, wherein each of the plurality of piece of spiral grass assembly further includes a grid plate with a shape consistent with a shape of the base plate, and the grid plate is arranged below the base plate, and is fixedly connected, through of a connecting piece, to the base plate and a row brush disposed adjacent to an edge of the base plate.

* * * * *